US011001275B2

(12) United States Patent
Sutterluety et al.

(10) Patent No.: US 11,001,275 B2
(45) Date of Patent: May 11, 2021

(54) CHAIR FOR A CHAIRLIFT

(71) Applicant: INNOVA PATENT GMBH, Wolfurt (AT)

(72) Inventors: Andreas Sutterluety, Egg (AT); Rene Passler, Wolfurt (AT)

(73) Assignee: Innova Patent GmbH, Wolfurt (AT)

( * ) Notice: Subject to any disclaimer, the term of this patent is extended or adjusted under 35 U.S.C. 154(b) by 361 days.

(21) Appl. No.: 15/742,598

(22) PCT Filed: Jul. 11, 2016

(86) PCT No.: PCT/EP2016/066432
§ 371 (c)(1),
(2) Date: Jan. 8, 2018

(87) PCT Pub. No.: WO2017/005934
PCT Pub. Date: Jan. 12, 2017

(65) Prior Publication Data

US 2018/0194370 A1 Jul. 12, 2018

(30) Foreign Application Priority Data

Jul. 9, 2015 (AT) ..... A 452/2015

(51) Int. Cl.
*B61B 12/00* (2006.01)
*B61B 11/00* (2006.01)

(52) U.S. Cl.
CPC ..... *B61B 12/002* (2013.01); *B61B 11/00* (2013.01)

(58) Field of Classification Search
CPC ..... B61B 12/002; B61B 12/06; B61B 11/00
USPC ..... 105/149.2
See application file for complete search history.

(56) References Cited

U.S. PATENT DOCUMENTS 6,106,067 A * 8/2000 Zhuang ..... B60N 2/232 297/361.1
7,377,220 B2 * 5/2008 Coudurier ..... B61B 12/002 105/149.2
7,690,313 B2 4/2010 Sutter et al.
7,984,678 B2 * 7/2011 Switzeny ..... B61B 12/002 104/173.2
8,590,458 B2 * 11/2013 Wieser ..... B61B 12/002 105/149.2
9,701,320 B2 * 7/2017 Chedal Bornu ..... B61B 12/002
(Continued)

FOREIGN PATENT DOCUMENTS

DE 102010017068 A1 11/2011
EP 0510357 B1 9/1994
(Continued)

OTHER PUBLICATIONS

Machine translation of EP-0808757-A1 (Year: 1997).*

*Primary Examiner* — Michael McCullough
(74) *Attorney, Agent, or Firm* — Laurence A. Greenberg; Werner H. Stemer; Ralph E. Locher

(57) ABSTRACT

A chair for chairlifts includes a pivotal installation that can pivot into a closed position and an open position, a locking element of the installation, and a blocking element for the locking element. The blocking element is movable into a blocking position and into a releasing position. A control element allows the blocking element to be moved from the blocking position and the installation to be opened. A chairlift and a method for activating a pivotable installation are also provided.

20 Claims, 8 Drawing Sheets

(56) References Cited

U.S. PATENT DOCUMENTS

| | | | | |
|---|---|---|---|---|
| 2015/0000548 | A1 | 1/2015 | Chedal Bornu | |
| 2018/0087300 | A1* | 3/2018 | Sutterluety | E05C 3/042 |
| 2018/0251137 | A1* | 9/2018 | Sutterluety | B61B 12/002 |
| 2019/0300022 | A1* | 10/2019 | Lanier | B61B 12/028 |

FOREIGN PATENT DOCUMENTS

| | | | | |
|---|---|---|---|---|
| EP | 0748732 | A1 | 12/1996 | |
| EP | 0808757 | A1 * | 11/1997 | B61B 12/002 |
| EP | 0808757 | A1 | 11/1997 | |
| EP | 1671867 | A1 | 6/2006 | |
| EP | 1780091 | A2 | 5/2007 | |
| EP | 2030858 | A2 | 3/2009 | |
| EP | 2810841 | A1 * | 12/2014 | B61B 12/122 |
| EP | 2810841 | A1 | 12/2014 | |
| JP | H0769209 | A | 3/1995 | |
| JP | 2006168725 | A | 6/2006 | |
| WO | 2008020021 | A1 | 2/2008 | |
| WO | 2013190220 | A1 | 12/2013 | |

* cited by examiner

CHAIR FOR A CHAIRLIFT

BACKGROUND OF THE INVENTION

Field of the Invention

The present invention relates to a chair for a chairlift, having a pivotal installation which is pivotable to a closed and to an opened position, having a locking element of the installation and having a blocking element for the locking element, the blocking element being movable to at least one locking position and one releasing position.

The present invention furthermore relates to a method for activating a pivotable installation which is pivoted between a closed and an opened position, having a locking element of the installation and having a blocking element which is moved from a locking position to a releasing position in order for the locking element to be released.

Chairs of chairlifts have a safety bracket in order for passengers to be safely transported. In the case of most hairlift systems used nowadays the safety brackets are closed and opened by the conveyed passengers themselves. In the case of chairlift systems of this type it is problematic that the safety brackets are often closed too late after boarding, or are opened too early ahead of the region of the station where the passengers wish to disembark, respectively. This poses an increased risk of falling particularly for children.

In order for the safety of the passengers to be enhanced it is known from EP 808 757 A for the safety bracket to be is locked in order for the latter not to be able to be opened too early by the passengers. In the case of this system it is to be considered disadvantageous that the safety bracket has to be manually closed and opened by the persons conveyed.

Therefore, in order for the safety and the comfort of the passengers to be enhanced, devices which close the bracket and lock the safety bracket by way of an externally activated transmission installation after passengers have boarded are also known. The safety bracket is again released from the locking action and opened by way of the externally activated transmission installation only shortly prior to alighting at the station.

SUMMARY OF THE INVENTION

It is an object of the present invention to achieve a device on chairs which offers the passenger improved safety and comfort, and preferably in the context of a modular kit system can also be retrofitted in the case of existing chairlifts.

This object is achieved by a chair for chairlifts, having a pivotal installation which is pivotable to a closed and to an opened position, having a locking element of the installation and having a blocking element for the locking element, the blocking element being movable to at least one locking position and one releasing position, and having a control element which moves the blocking element from the locking position to the releasing position and is connected to the installation.

The object is furthermore achieved by a method for activating a pivotable installation which is pivoted between a closed and an opened position, having a locking element of the installation and having a blocking element which is moved from a locking position to a releasing position in order for the locking element to be released, wherein the control element first moves the blocking element to the releasing position and then pivots the installation from the closed to the opened position.

According to the invention, pivotable installations can be pivoted by way of the device and be blocked by way of a locking element on the installation. Pivotable installations of a chairlift include in particular protective installations such as safety brackets and weather protection hoods, and seats or parts of seats such as seat parts and back parts, respectively, to which reference will be made in an exemplary and non-limiting manner in the description hereunder.

By way of the arrangement of at least one locking system on the chair, manual opening of the safety bracket by the passengers while in motion can be prevented, for example. The locking herein is performed in a form-fitting manner by way of a linear or rotary movement of a blocking element in a depression or recess on a locking element that is connected to the installation. A control element which preferably engages on a bolt on the locking element of the safety bracket in order for the safety bracket to be automatically opened is used for opening the installation or the safety bracket, respectively.

The device according to the invention can also be used for an externally activated pivoting, in particular the folding up, of a seat part, or the folding down of a back part, respectively. To this end, the control element, as is preferred in the case of a safety bracket, by way of a bolt engages on a locking element of the seat part or of the back part, respectively, so as to automatically open or close the latter. In order to prevent any unintentional folding up of the seat part or folding down of the back part, respectively, said seat part or back part are locked again as has been described in the case of the safety bracket. By way of the device according to the invention on the seat, deposits on the seat part can be prevented, or no lift personnel has to be provided for pivoting the seat parts when parking, in the case of snowfall. Furthermore, on account of the locking action of the seat part or the back part, respectively, is secured against unintentional pivoting by wind.

The control element preferably has a control curve, the blocking element preferably bearing on said control curve under a spring force. When the control element is moved the blocking element that bears on the control curve is first moved out of the depression or recess, respectively, of the blocking element whereupon the installation, for example the safety bracket, is subsequently opened.

In order for an externally activated pivoting of the installation, in particular the opening or else the closing of the safety bracket, respectively, to be implemented in addition to the locking action, two different embodiments of the control element are preferred.

In the case of one embodiment in which the safety bracket is closed, locked, unblocked and opened by way of the externally activated control element, the control element for releasing the locking element preferably has a short opening in which the bolt of the locking element engages. The short opening, for example a slot, in the direction of movement of the control element is as long as the path of the control element for moving the blocking element from the locking position to the releasing position, plus the diameter of the bolt. The width of the opening must be at least as large as the bolt of the locking element that is guided in said opening.

In order for manual closing and locking by a passenger, yet an externally activated unlocking and opening of the safety bracket prior to alighting to be affected, a long opening, for example a long slot, is preferably disposed in the control element. The opening must be at least as long as the length of the movement of the bolt of the locking element from the opened to the closed position of the safety bracket, plus the length of the path of the control element for moving the blocking element from the locking position to the releasing position, plus the diameter of the bolt.

By contrast to the first-mentioned variant, only the locking element is released in the closing procedure by way of the external activation of the control element. The control element in this instance can move in the direction of the locking position thereof without conjointly moving the safety bracket by way of the bolt of the locking element since said bolt can move in the lengthened slot. The safety bracket is locked by way of the locking element only once the safety bracket has been pivoted by a passenger so far downward that the blocking element can latch into the depression on the locking element.

The control element is preferably displaced in a preferably substantially linear manner by way of a transmission installation, wherein the transmission installation furthermore preferably has an activation installation which is set in motion by means of a mechanical, pneumatic, hydraulic, or electrical drive. A mechanical activation of the control element, in particular by way of the transmission installation, by means of a Bowden control or a linkage is preferred.

Further preferred embodiments of the invention are the subject matter of the remaining dependent claims.

BRIEF DESCRIPTION OF THE SEVERAL VIEWS OF THE DRAWING

Further features and advantages of the invention are derived from the following description of preferred exemplary embodiments of the invention with reference to the appended drawings in which.

DESCRIPTION OF THE INVENTION

Figure 2:
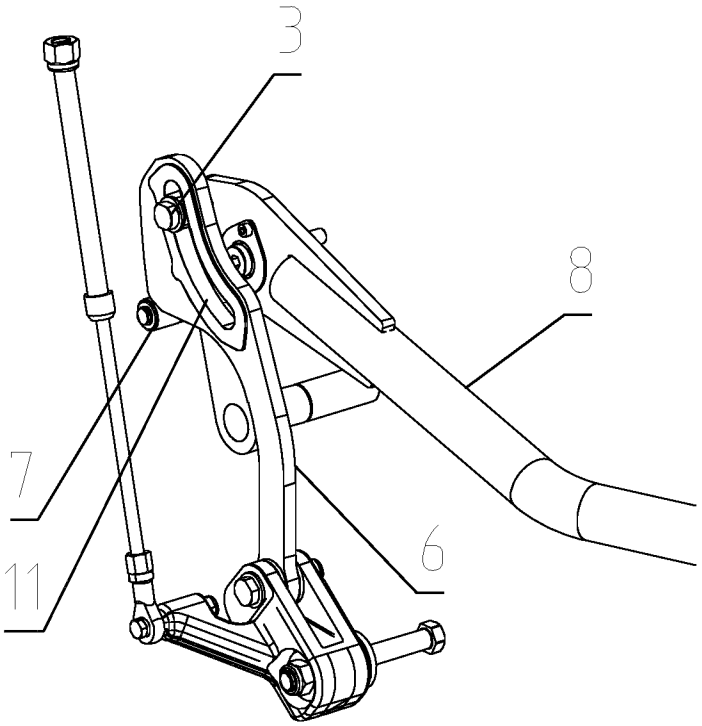
FIG. 2 shows a second embodiment of a locking system according to the invention, having a closed bracket.

Locking devices 1 in 2 preferred embodiments are shown in FIGS. 1 to 12. An installation 8, in the embodiment illustrated a safety bracket, is connected, for example welded, to a locking element 10. The locking element 10 by way of a bore and of a bolt 13 located in the latter is connected to a frame of the chair of a chairlift, and conjointly with the safety bracket 8 can be pivoted about the bolt 13. A bolt 3 which can move in an opening, in the embodiment illustrated in a slot 9 (FIG. 1) or 11 (FIG. 2), which is located in the control element 6 which controls the locking and movement of the safety bracket 8 is furthermore located on the locking element 10. A mechanical reversal between the locking installation 10 and the control element 6 in that the bolt 3 which engages on the locking element 10 in order for the pivotable installation 8 to be opened is located on the control element 6 is possible.

In order for unlocking and locking according to the invention by means of a preferably spring-loaded blocking element 7 to be controlled, the shape of a control curve 15 of the control element 6 on which the blocking element 7 bears, and the movement path of the bolt 3 and the shape or the arrangement, respectively, of the slot 9 or 11, respectively, are decisive. Depending on the length of the slot 9 or 11, respectively, apart from an externally activated opening an externally activated closing of the safety bracket 8 can also be effected when required.

A transmission installation 2 is assigned to the control element 6 in order to enable an externally activated unlocking, opening, and potential closing. Said transmission installation 2 has a tilting element 5 which at one end is connected to a Bowden control 4 and at the other end is connected to the control element 6. The movement of the Bowden control 4 is transmitted to the control element 6 by way of the tilting element 5. However, the tilting element 5 could also be omitted, and the Bowden control 4 or another drive could act directly on the control element 6, for example. The control element 6 could also be moved in a rotatory manner and not in a substantially translatory manner as is illustrated and described.

The Bowden control 4 is activated by way of a tilt lever on the support bar of the chairlift, for example, such as is disclosed in EP 1 780 091 A, for example. The tilting element 5 is fitted to a bolt 12 so as to be pivotable on the frame of the chair. The blocking element 7, under tension by a spring, bears on the control curve 15 of the control element 6. The blocking element 7 is mounted so as to be pivotable on the frame of the chair and in the closed and locked state (cf. FIG. 1) of the locking element 10 engages in a depression 14 or recess on the locking element 10.

Figure 1:
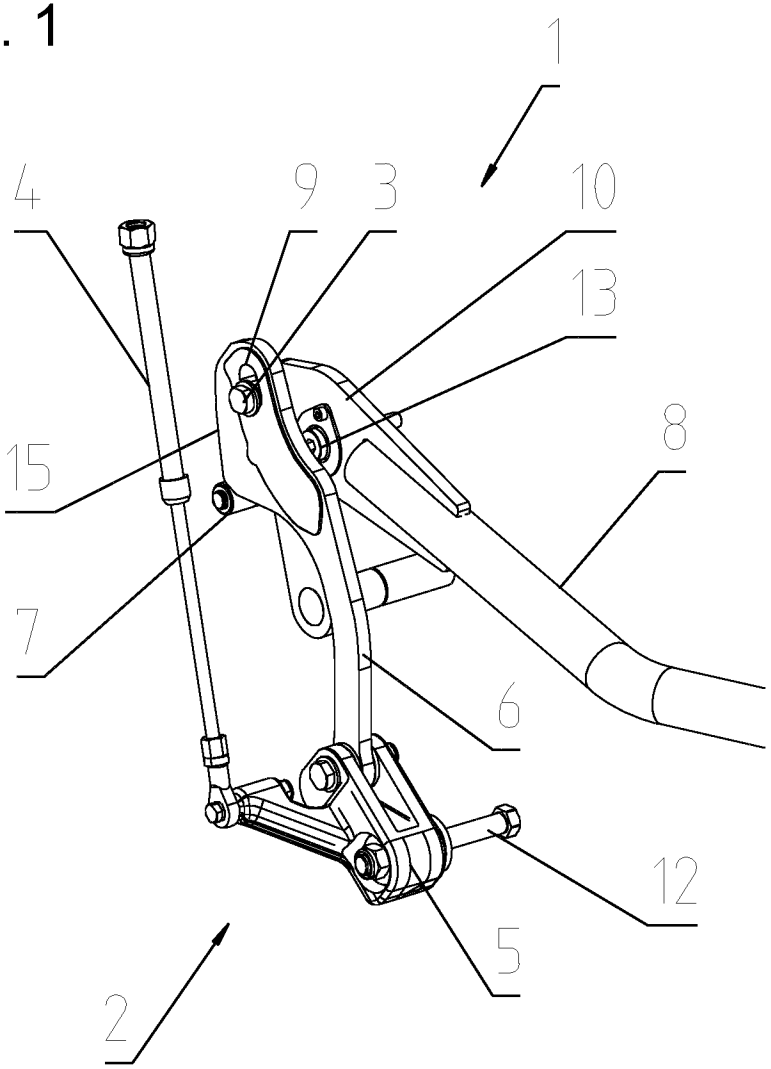
FIG. 1 shows a first embodiment of a locking system according to the invention, having a closed bracket.

A first preferred embodiment of the locking device 1 according to the invention is shown in FIG. 1. The safety bracket 8 in the illustration is in the closed position, the blocking element 7 engaging in the depression 14 of the locking element 10. In the state shown, the transmission installation 2, composed of the Bowden control 4 and of the tilting element 5, conjointly with the control element 6 is at the highest point. In this position, the bolt 3 of the locking element 10 bears on the lower end of the short slot 9. The control element 6 does not deflect the blocking element 7, and the safety bracket 8 is closed and locked.

FIG. 2 shows the substantially identical arrangement of the components of FIG. 1 in the locked position. However, a substantial point of differentiation in relation to FIG. 1 is that the slot 11 of the control element 6 is as long as the path of the bolt 3 from the topmost position to the lowermost position of the safety bracket 8. To this is added the length of the path of the control element 6 for moving the blocking element 7 from the locking position to the releasing position, as will be explained by means of FIG. 3, plus the diameter of the bolt 3 and any potential clearance.

Figure 3:
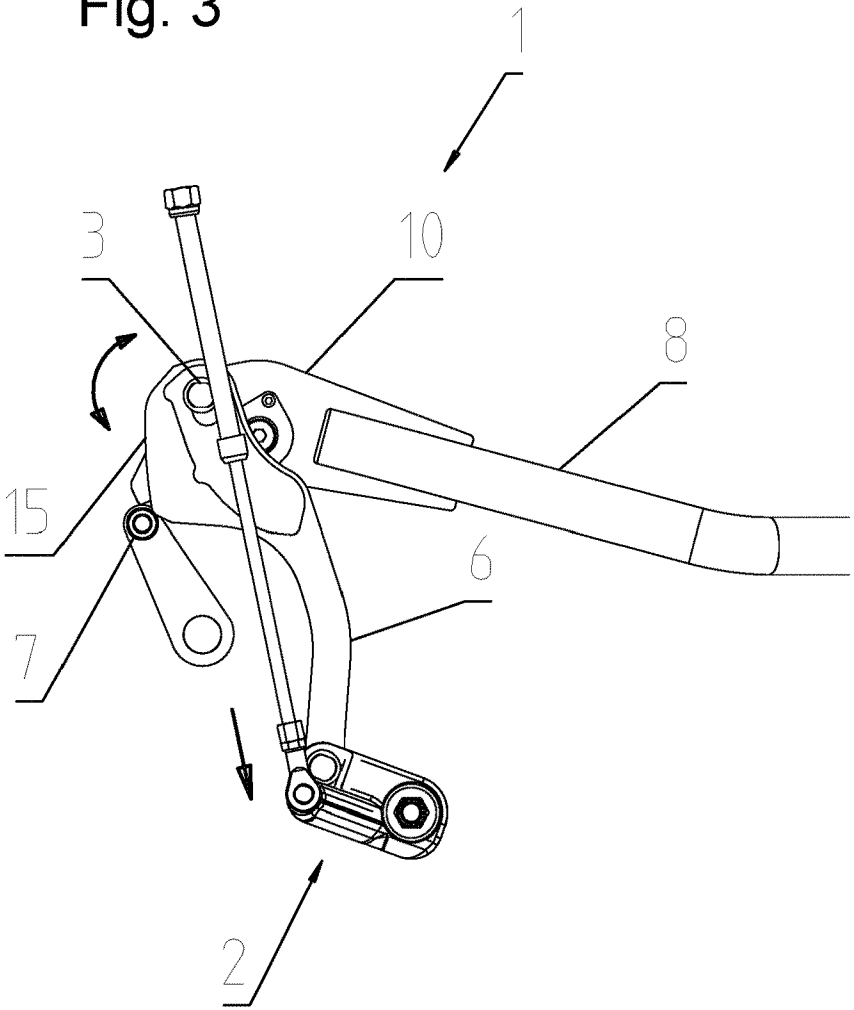

FIG. 3 shows the beginning of the externally activated unlocking of the blocking element 7 in the case of the embodiment of FIG. 1. The control element 6 herein by way of the transmission installation 2 is first displaced so far that the blocking element 7 that bears on the control curve 15 releases the locking element 10. The blocking element 7 that bears on the control element 6 in this position is deflected so far that the locking element 10 can move past the blocking element 7 when the safety bracket 8 is opened. The bolt 3 of the locking element 10 bears on the topmost end of the slot 9 when the blocking element 7 is deflected so far that the safety bracket 8 on the locking element 10 can be opened by the control element 6.

Figure 4:
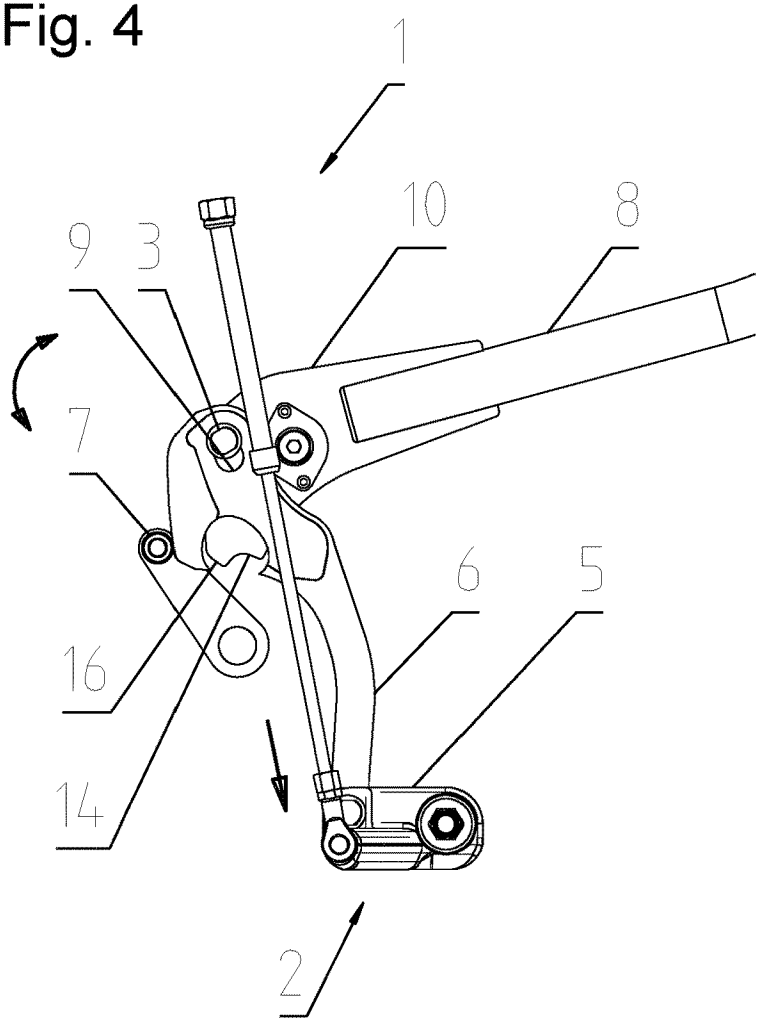
FIGS. 3 to 8 show views of the locking system according to the embodiment of FIG. 1 in various positions during the opening and the closing of the safety bracket.

The further rotary motion sequence of the safety bracket 8 after the release of the locking element 10 is illustrated as from FIG. 4. A protrusion 16 on the depression 14 of the locking element 10 has already been moved past the blocking element 7. On account of the operative connection between the control element 6 and the bolt 3 at the upper end of the slot 9, the safety bracket 8, under the influence of the transmission installation 2 on the control element 6, in a rotary manner is moved upward or is opened, respectively.

Figure 5:
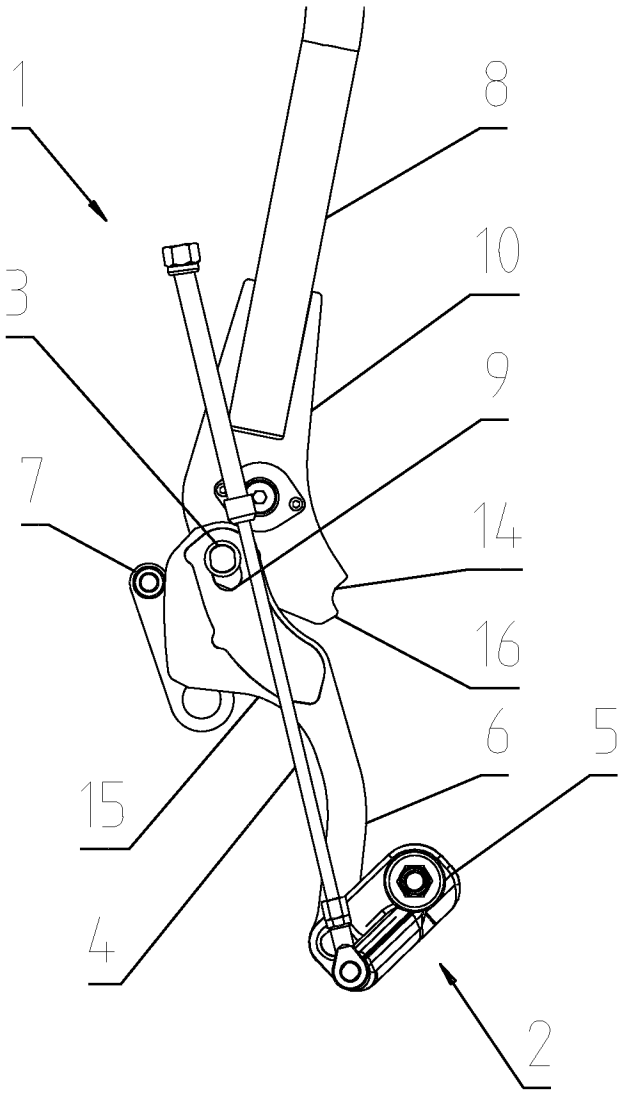

The safety bracket 8 in a completely opened position is depicted in FIG. 5. The transmission installation 2 and the control element 6 are in the lowermost position. The safety bracket 8 in the opened position is held by the bolt 3 that bears on the upper end of the slot 9.

Figure 6:
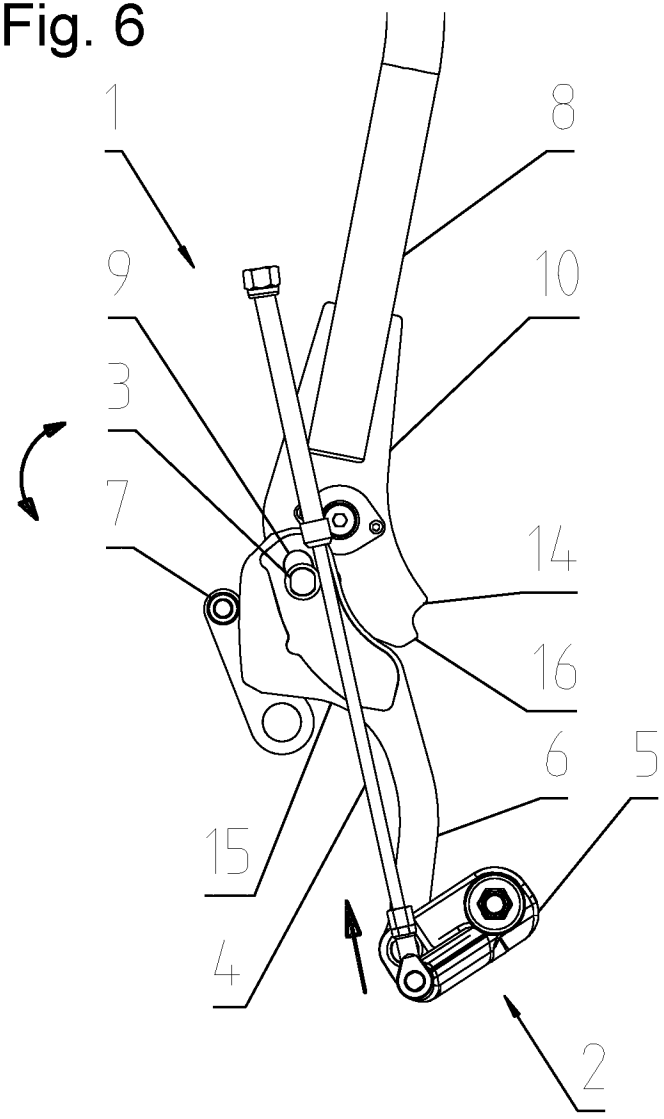

The beginning of the externally activated closing procedure is illustrated in FIG. 6. In order for this to be established, the slot 9 of the control element 6 in the short embodiment has to be used. The bolt 3 of the locking element 10 is in the lowermost position of the short slot 9, and the safety bracket 8 by way of the operative connection between the bolt 3 and the control of element 6 is moved downward to the closed position in that the transmission installation 2 moves the control element 6 upward.

Figure 7:
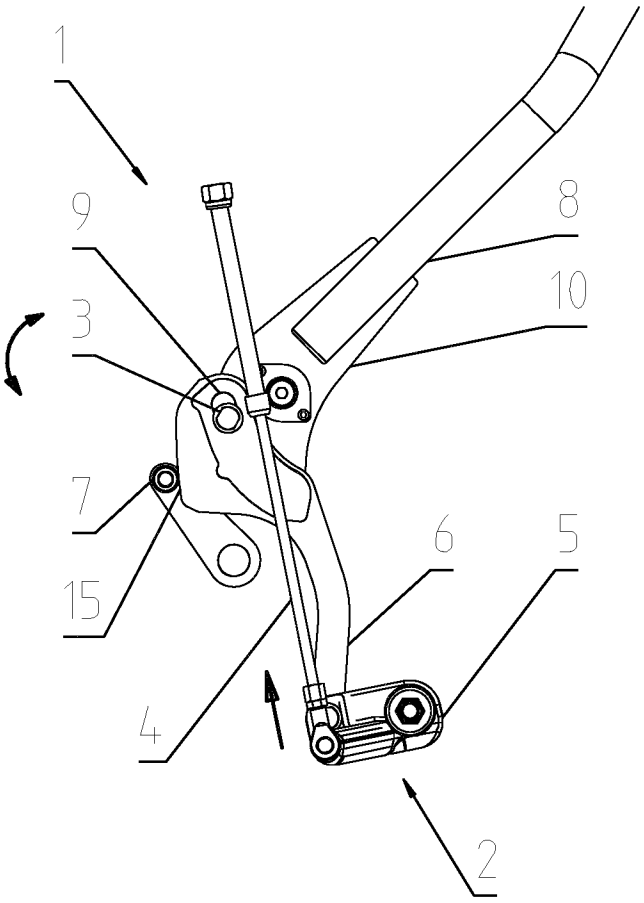

The safety bracket 8 in FIG. 7 has already been moved further down. The blocking element 7 continues to move along the control curve 15 of the control element 6 and is in the releasing position until the blocking element 7 bears on the protrusion 16 and, continuing therefrom, the end position of FIG. 8 is reached.

Figure 8:
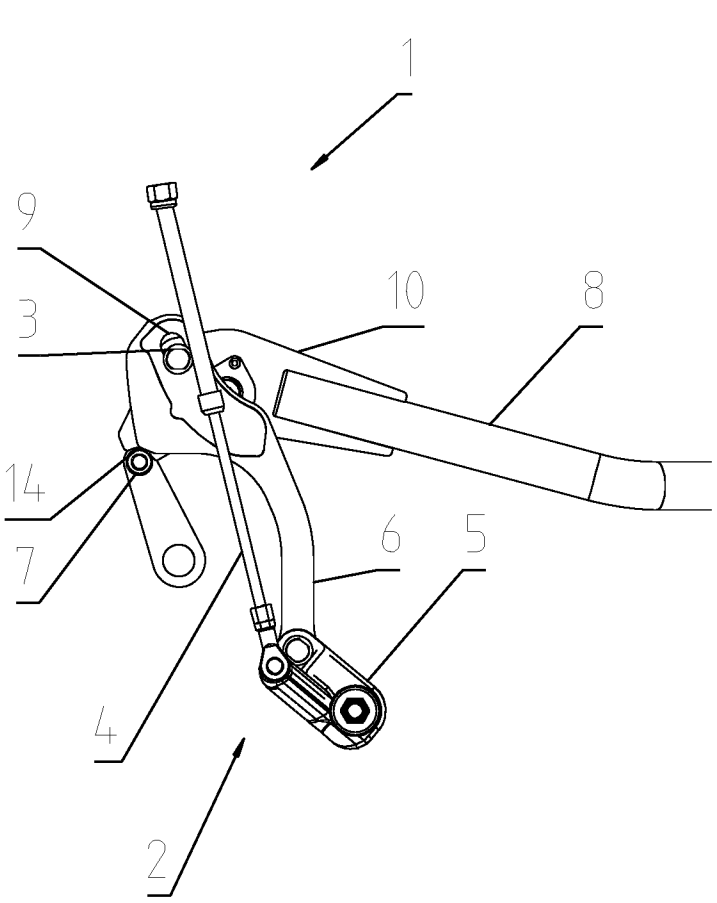

FIG. 8 shows the safety bracket 8 that at the end of this closing procedure is closed and locked. The transmission installation 2 and the control element 6 are again in the highest position, and the blocking element 7 is latched into the depression 14.

Figure 9:
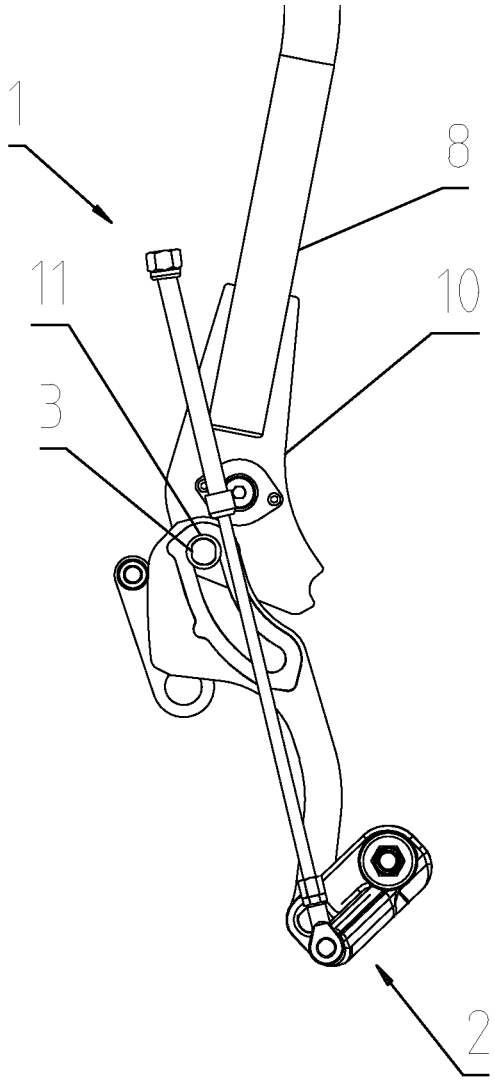
FIGS. 9 to 12 show views of the locking system according to the embodiment of FIG. 2 in various positions during the closing of the safety bracket.

FIG. 9 for the embodiment of FIG. 2 shows the same position of the components as in FIG. 5 once the safety bracket 8 has been opened as has been described in the context of FIGS. 3 to 5. The safety bracket 8 is in the opened position, and the bolt 3 of the locking element 10 is at the topmost position of the slot 11. A lengthened slot 11 is now used instead of the short slot 9 (as is illustrated in FIG. 5).

Figure 10:
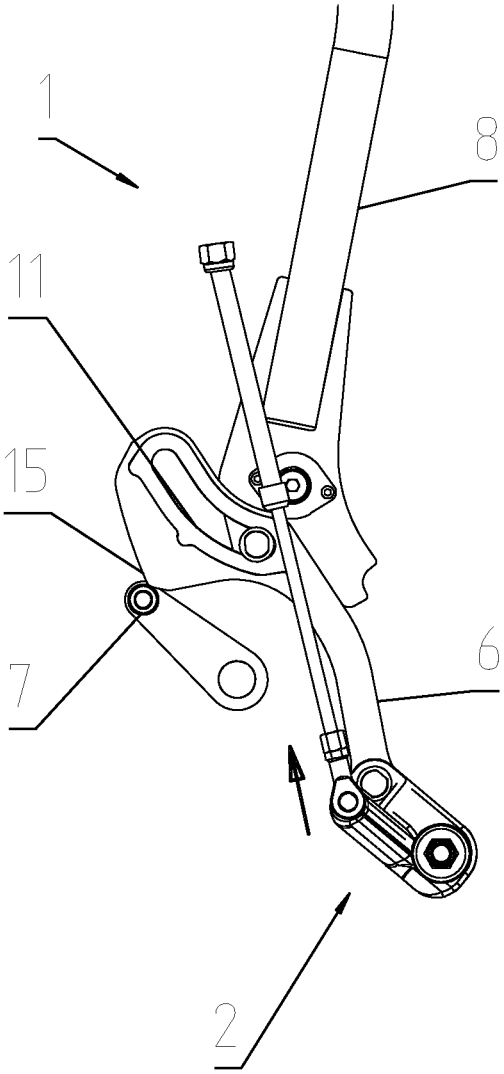

In FIG. 10 the control element 6 that by the transmission installation 2 has been moved right to the top is again in the same position as shown in FIG. 2, the substantial difference being that the safety bracket 8 has not been conjointly moved and closed by virtue of the long slot 11. The safety bracket 8 in the illustrated position of the control element 6 can be manually closed by a passenger, as is shown in FIGS. 11 and 12.

Figure 11:
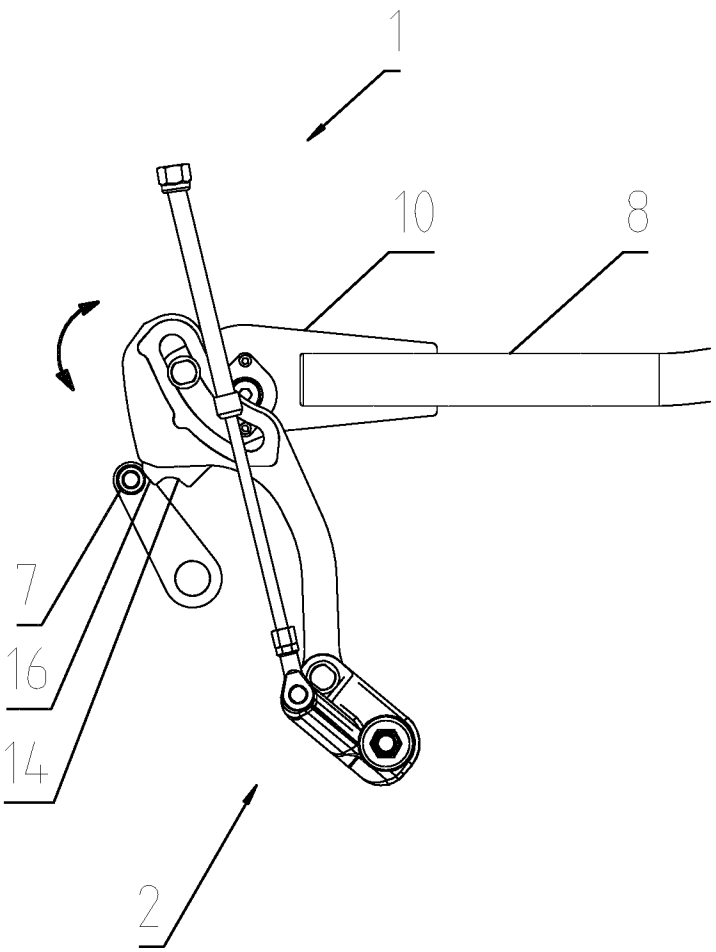

The safety bracket 8 in FIG. 11 has already been partially manually closed by a passenger. The blocking element 7 now bears on the protrusion 16 of the depression 14 of the locking element 10.

In the case of this embodiment, a plurality of depressions or recesses can be provided sequentially on the locking element 10 in the direction of movements such that the blocking element 7 during the closing procedure successively engages in one recess or depression after the other, thus progressively blocking the safety bracket 8 successively and in a step-by-step manner from being opened again by a passenger.

Figure 12:
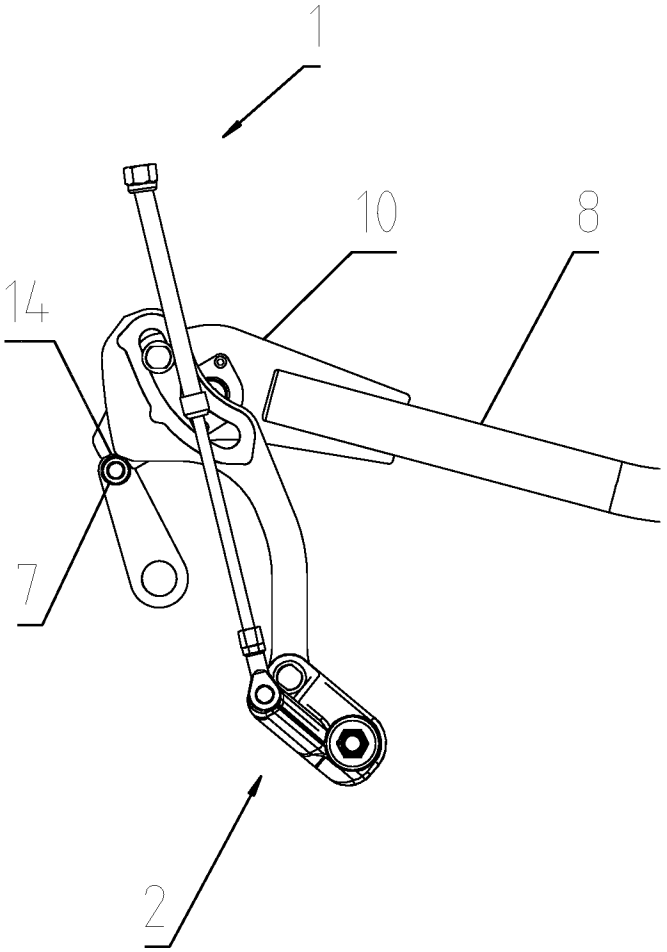

The locking element 10 in FIG. 12 is locked by the blocking element 7, as is also illustrated in FIG. 2. The blocking element 7 is again in the depression 14 of the locking element 10, and blocks the safety bracket 8 in the closed position. The safety bracket 8 can only be unlocked and opened again by external activation by way of the transmission installation 2.

The locking device 1 according to the invention can also be used, according to the same principle as has been described in FIGS. 1 to 12 for weather protection hoods, for example.

Figure 13:
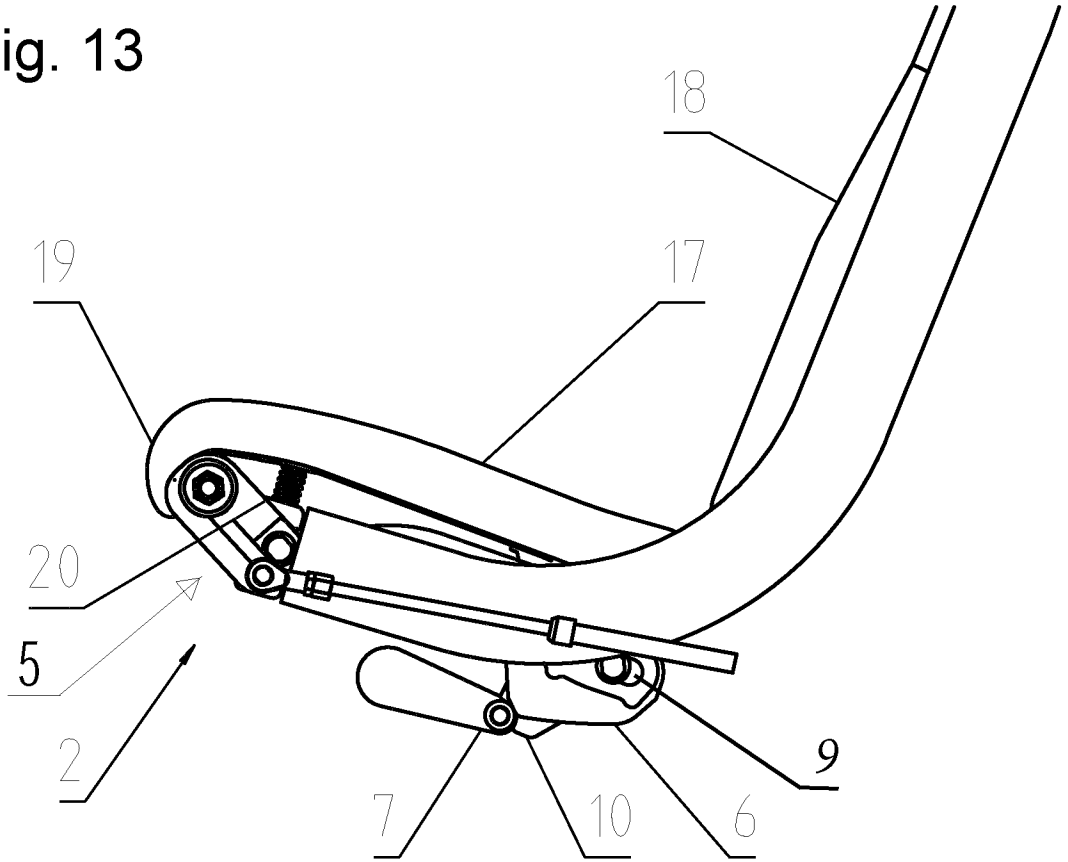
FIG. 13 shows an embodiment of the locking system according to the invention for a seat part of a chairlift.

The use for an externally activated pivoting of a seat part 17 of a seat of a chairlift is illustrated in FIG. 13. The functions and embodiments of the slots 9 or 11, respectively, in the short or long embodiment in the control element 6 correspond to those that have already been described in FIGS. 3 to 12. As is illustrated in FIG. 13, the locking device 1 can also be disposed between the seat part 17 and the frame of the seat, said seat part 17 in this illustration being in the sitting position. The locking element 10 is connected to the seat part 17 in order for the seat parts to be pivoted to the opened and the closed position. The same device can also serve for pivoting a back part 18. In the context of the invention, the seat part 17 in the position according to FIG. 13, in which people can sit on said seat part 17, is in the "opened" position, and in the folded-up position is in the "closed" position. The back part 18 in the position according to FIG. 13, in which people can set on the seat, is in the "opened" position, and in the folded-down position is in the "closed" position.

A further improved embodiment of the locking device 1 on the seat part 17 serves for enhancing the comfort and the safety when boarding and alighting, in particular for comparatively small passengers and those with mobility difficulties. In order for boarding and alighting to be facilitated, it is advantageous for a front edge 19 of the seat part 17 to be inclined downward as far as possible. In order for this to be enabled, a force by way of which the seat part 17 by way of the locking element 10 is pushed further down against an elastic element 20 can be applied to the control element 6 by way of the transmission installation 2. Once the passengers are seated, the tilting element 5 of the locking device 1 is de-stressed. The front edge 19 is moved upward again on account of the force that is stored in the elastic element 20, the seat part 17 is slightly reclined, and the blocking element 7 latches back into the depression 14 of the locking element 10. Thus the spacing between the seat part 17 and the safety bracket 8 is thus also decreased, and the risk of comparatively small passengers slipping through below the safety bracket 8 is reduced. Should in individual cases comparatively heavy people be sitting on the seat, for whom the force of the spring 20 is not sufficient in order for the seat part 17 to be raised again, this is not disadvantageous but rather offers the additional advantage that there is automatically more space below the safety bracket 8 for these people who are in most cases also comparatively large, thus enhancing the comfort for these people.

The depression 14 on the locking element, or a further depression, can also be disposed such that the blocking element 7 latches when the seat part is in the lowermost position, on account of which the seat part remains in the lowermost boarding and alighting position during the entire passage of the chair through a station.

Figure 14:
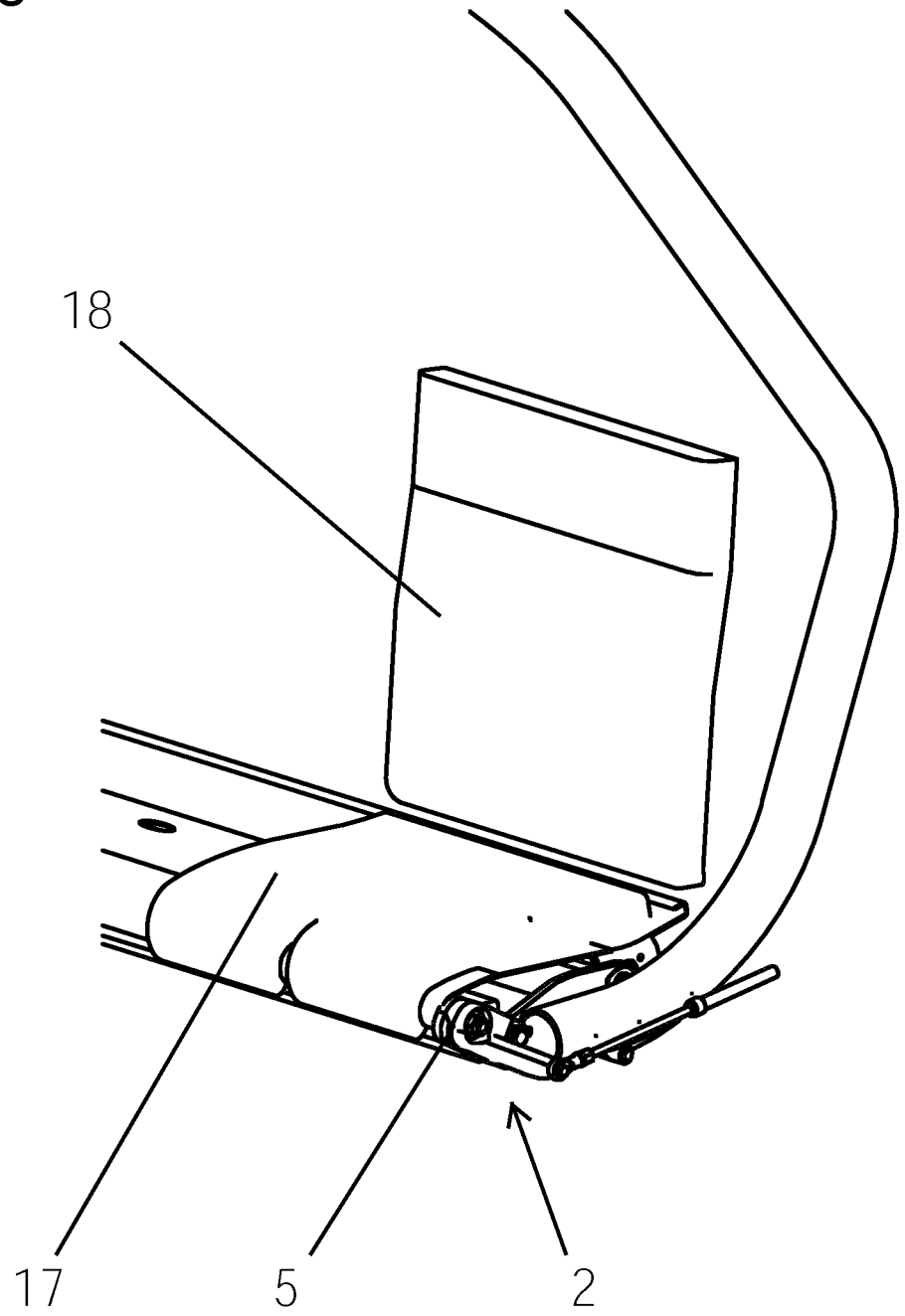
FIG. 14 shows an oblique view of FIG. 13.

For improved visualization, FIG. 14 shows the embodiment of the locking device 1 described in FIG. 13 in an oblique view.

The invention claimed is:

1. A chair for chairlifts, the chair comprising:

a pivotable installation being pivotable into a closed position and into an opened position, said installation having a locking element;

a blocking element for said locking element, said blocking element being movable into at least one locking position and one releasing position; and a control element for moving said blocking element from said locking position into said releasing position, said control element being connected to said installation, said control element configured for moving said installation into said opened position.

2. The chair according to claim 1, wherein said control element has a control curve, and said blocking element bears against said control curve.

3. The chair according to claim 1, wherein said locking element has at least one depression or recess in which said blocking element engages in said locking position.

4. The chair according to claim 1, wherein said control element is operatively connected to said installation in only one direction of movement.

5. The chair according to claim 1, which further comprises a bolt connected to said installation, said control element having an opening in which said bolt engages.

6. The chair according to claim 5, wherein:

said bolt has a diameter;

said control element has a direction of movement and a path for moving said blocking element from said locking position into said releasing position; and said opening has a length in said direction of movement of said control element being at least as large as said path of said control element plus said diameter of said bolt.

7. The chair according to claim 5, wherein:

said bolt has a diameter and a length of movement from said opened to said closed position of said installation;

said control element has a direction of movement and a path for moving said blocking element from said locking position into said releasing position; and said opening has a length in said direction of movement of said control element being at least as large as said length of movement of said bolt plus said path of said control element plus said diameter of said bolt.

8. The chair according to claim 1, which further comprises a transmission installation for said control element.

9. The chair according to claim 8, wherein said transmission installation has a mechanical, pneumatic, hydraulic, or electrical drive.

10. The chair according to claim 9, wherein said transmission installation has a Bowden control or a linkage.

11. The chair according to claim 9, wherein said transmission installation has a tilting element displacing said control element.

12. The chair according to claim 1, wherein said blocking element engages in said locking element by way of a rotary or linear movement.

13. The chair according to claim 1, wherein said installation is a safety bracket, a weather protection hood, a seat part, or a back part.

14. A chairlift, comprising:

a chair according to claim 1.

15. The chair according to claim 1, wherein said control element is directly connected to said installation.

16. A method for activating a pivotable installation being pivotable between a closed position and an opened position, the method comprising the following steps:

providing the installation with a locking element;

providing a blocking element being movable from a locking position into a releasing position for releasing the locking element; and using a control element to initially move the blocking element to the releasing position and using the control element to then pivot the installation from the closed position to the opened position.

17. The method according to claim 16, which further comprises closing the installation by moving the control element back to a position in which the blocking element is movable into the locking position.

18. The method according to claim 17, which further comprises carrying out a return movement of the control element to pivot the installation into the closed position.

19. The method according to claim 17, wherein the control element carries out the return movement by way of an elongate slot and leaves the installation in the opened position, requiring the installation to be closed manually.

20. The method according to claim 16, which further comprises directly connecting the control element to the installation.

* * * * *